US008240987B2

(12) United States Patent
Spangler et al.

(10) Patent No.: US 8,240,987 B2
(45) Date of Patent: Aug. 14, 2012

(54) GAS TURBINE ENGINE SYSTEMS INVOLVING BAFFLE ASSEMBLIES

(75) Inventors: Brandon W. Spangler, Vernon, CT (US); Jeffrey S. Beattie, West Hartford, CT (US)

(73) Assignee: United Technologies Corp., Hartford, CT (US)

( * ) Notice: Subject to any disclaimer, the term of this patent is extended or adjusted under 35 U.S.C. 154(b) by 1001 days.

(21) Appl. No.: 12/192,362

(22) Filed: Aug. 15, 2008

(65) Prior Publication Data

US 2010/0040479 A1 Feb. 18, 2010

(51) Int. Cl.
*F01D 25/08* (2006.01)

(52) U.S. Cl. ..... 415/178; 415/115; 415/177; 415/119; 416/96 A

(58) Field of Classification Search ..... 415/173.1, 415/173.6, 119, 115, 177, 178; 416/191, 416/193 A, 193 R, 221, 500, 96 R, 97 R, 416/96 A See application file for complete search history.

(56) References Cited

U.S. PATENT DOCUMENTS 3,266,770 A * 8/1966 Harlow ..... 416/92
3,610,778 A * 10/1971 Suter ..... 416/210 R
3,628,880 A * 12/1971 Smuland et al. ..... 415/175
4,712,979 A 12/1987 Finger
5,281,097 A 1/1994 Wilson et al.
5,344,283 A 9/1994 Magowan et al.
5,382,135 A 1/1995 Green
5,413,458 A 5/1995 Calderbank
6,017,189 A 1/2000 Judet et al.
6,120,249 A 9/2000 Hultgren et al.
6,457,935 B1 * 10/2002 Antunes et al. ..... 415/115
6,945,749 B2 9/2005 De Cardenas
7,186,089 B2 3/2007 Liang
7,255,536 B2 8/2007 Cunha et al.
2005/0232752 A1 * 10/2005 Meisels ..... 415/116
2006/0034679 A1 * 2/2006 Harding et al. ..... 415/115
2006/0093484 A1 * 5/2006 Liang ..... 416/193 A
2006/0120869 A1 * 6/2006 Wilson et al. ..... 416/97 R
2006/0216146 A1 * 9/2006 Thompson et al. ..... 415/213.1
2007/0122266 A1 * 5/2007 Cairo et al. ..... 415/134

* cited by examiner

*Primary Examiner* — Ajay K Arora
(74) *Attorney, Agent, or Firm* — Carlson, Gaskey & Olds, P.C.

(57) ABSTRACT

Gas turbine engine systems involving baffle assemblies are provided. In this regard, a representative baffle assembly for a gas turbine engine includes: a cooling plenum defining a cooling air path; and a baffle sized and shaped to extend between surfaces of the cooling plenum such that a cooling air path of reduced cross-section is formed between the baffle and the surfaces, the baffle being operative to increase a flow rate of cooling air as the cooling air directed to the cooling air path is redirected through the cooling air path of reduced cross-section.

14 Claims, 5 Drawing Sheets

GAS TURBINE ENGINE SYSTEMS INVOLVING BAFFLE ASSEMBLIES

RESEARCH AND DEVELOPMENT

The U.S. Government may have an interest in the subject matter of this disclosure as provided for by the terms of contract number N00019-02-C-3003 awarded by the U.S. Navy.

BACKGROUND

1. Technical Field

The disclosure generally relates to gas turbine engines.

2. Description of the Related Art

Various gas turbine engine components, such as turbine blades, can experience platform distress due to high platform metal temperatures and low backside heat transfer. By way of example, platform distress can include creep (or deformation), thermo-mechanical fatigue (TMF), and oxidation in areas that are difficult to cool. Notably, blade platforms oftentimes rely on filmholes that route cooling air to the heated surfaces of the platforms.

SUMMARY

Gas turbine engine systems involving baffle assemblies are provided. In this regard, an exemplary embodiment of a baffle assembly for a gas turbine engine comprises: a cooling plenum defining a cooling air path; and a baffle sized and shaped to extend between surfaces of the cooling plenum such that a cooling air path of reduced cross-section is formed between the baffle and the surfaces, the baffle being operative to increase a flow rate of cooling air as the cooling air directed to the cooling air path is redirected through the cooling air path of reduced cross-section.

An exemplary embodiment of a gas turbine engine assembly comprises: a turbine disk; and a blade assembly having a first blade, a second blade and a baffle, the first blade and the second blade being operative to attach to the turbine disk; the first blade having a first inner diameter platform with an outer diameter side and an inner diameter side; the second blade having a second inner diameter platform with an outer diameter side and an inner diameter side; the baffle operative to form a cooling air path between the baffle and respective inner diameter sides of the first platform and the second platform.

An exemplary embodiment of a gas turbine engine comprises: a compressor; a turbine operative to drive the compressor; a cooling plenum defining a cooling air path for cooling the turbine; and a baffle sized and shaped to extend between surfaces of the cooling plenum such that a cooling air path of reduced cross-section is formed between the baffle and the surfaces, the baffle being operative to increase a flow rate of cooling air as the cooling air directed to the cooling air path is redirected through the cooling air path of reduced cross-section.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving baffle assemblies are provided, several exemplary embodiments of which will be described in detail. In various embodiments, a baffle (e.g., a removable, free-floating baffle) is utilized to reduce the effective cross-sectional area through which cooling air flows, such as a cooling plenum associated with one or more vanes, blades and/or blade outer air seals. Notably, blade platforms are structures (typically integrated with one or more blade airfoils) that define the inner diameter confines of the gas path that directs gas across the blade airfoils. By reducing the size of the cooling plenum that defines a cooling air path on the non-gas path sides of the inner diameter platforms, flow velocity of cooling air in a vicinity of the blade platform is increased. This tends to increase heat transfer and decrease platform temperature, thereby potentially decreasing platform distress.

Figure 1:
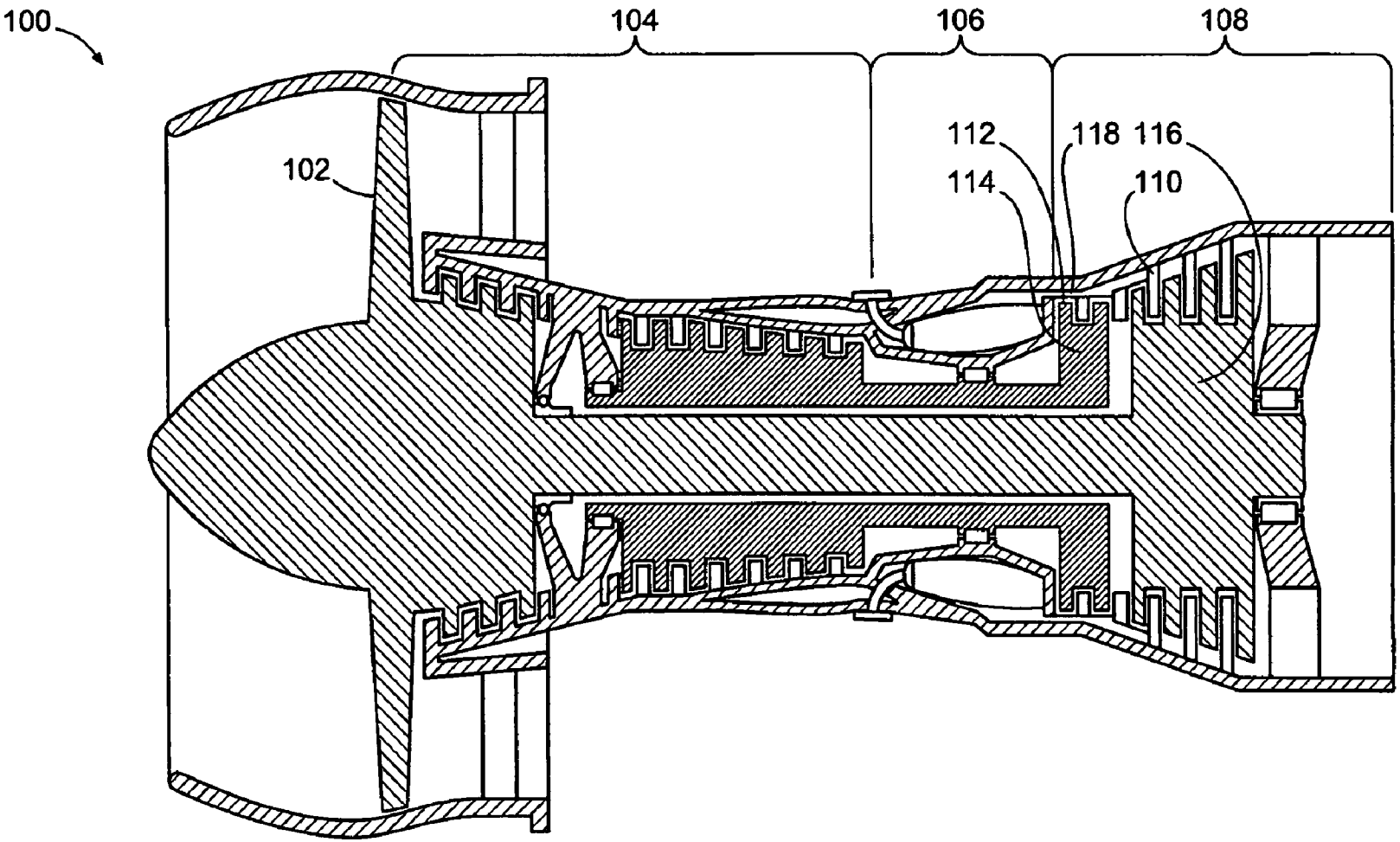
FIG. 1 is a schematic diagram depicting an exemplary embodiment of a gas turbine engine.

In this regard, FIG. 1 is a schematic diagram depicting an exemplary embodiment of a gas turbine engine 100. As shown in FIG. 1, engine 100 is depicted as a turbofan that incorporates a fan 102, a compressor section 104, a combustion section 106 and a turbine section 108. Turbine section 108 includes a high pressure turbine 114 and a low pressure turbine 116, each of which incorporates alternating sets of stationary vanes (e.g., vane 110) and a disk carrying blades (e.g., blade 112). Additionally, blade outer air seals (e.g., seal 118) are positioned radially outboard of the blades to reduce undesired gas leakage at the tips of the rotating blades. Although depicted as a turbofan gas turbine engine, it should be understood that the concepts described herein are not limited to use with turbofans as the teachings may be applied to other types of gas turbine engines.

Figure 2:
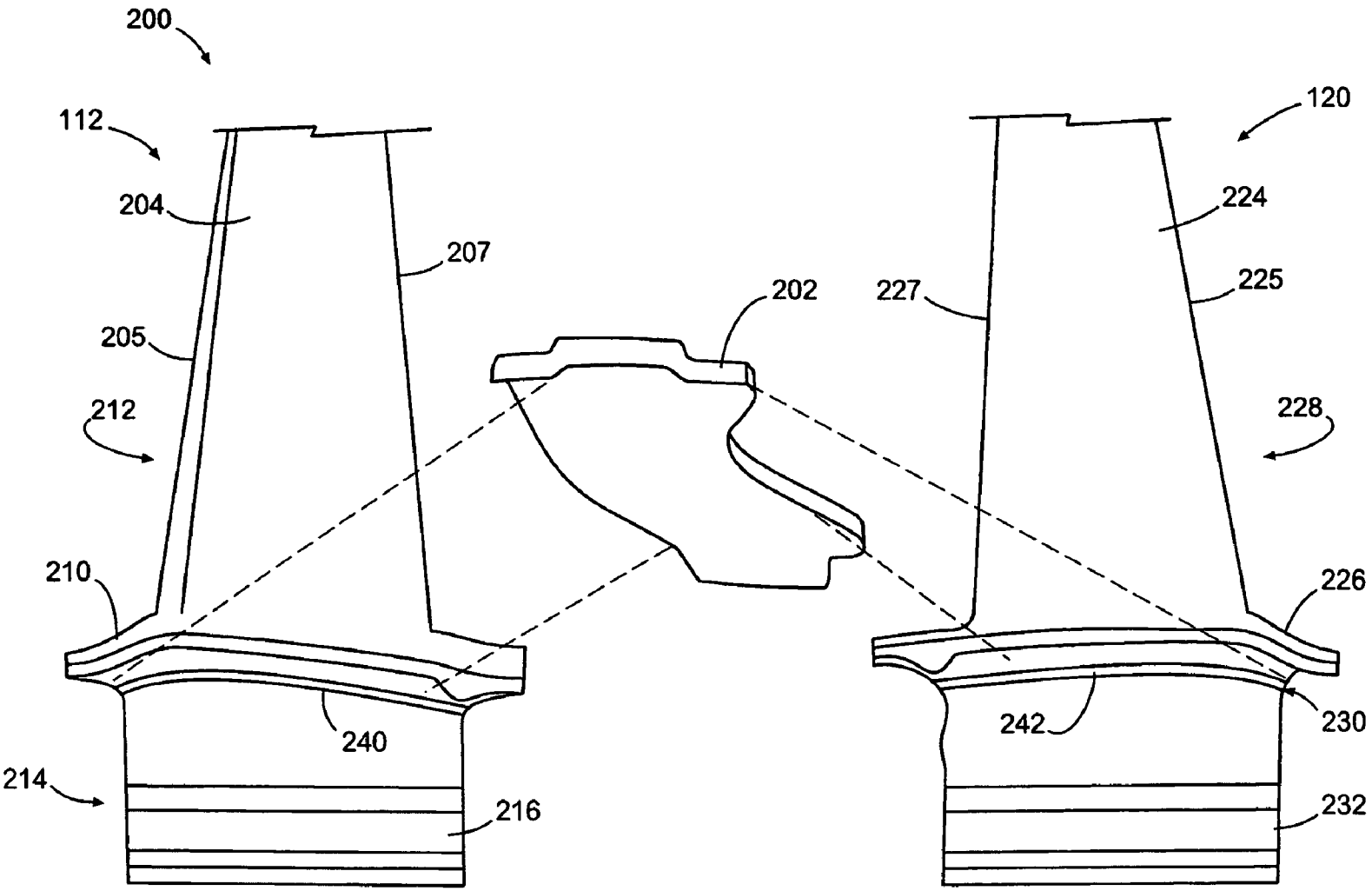
FIG. 2 is an expanded, cross-sectional diagram depicting a portion of the embodiment of FIG. 1, showing detail of a baffle assembly.
Figure 3:
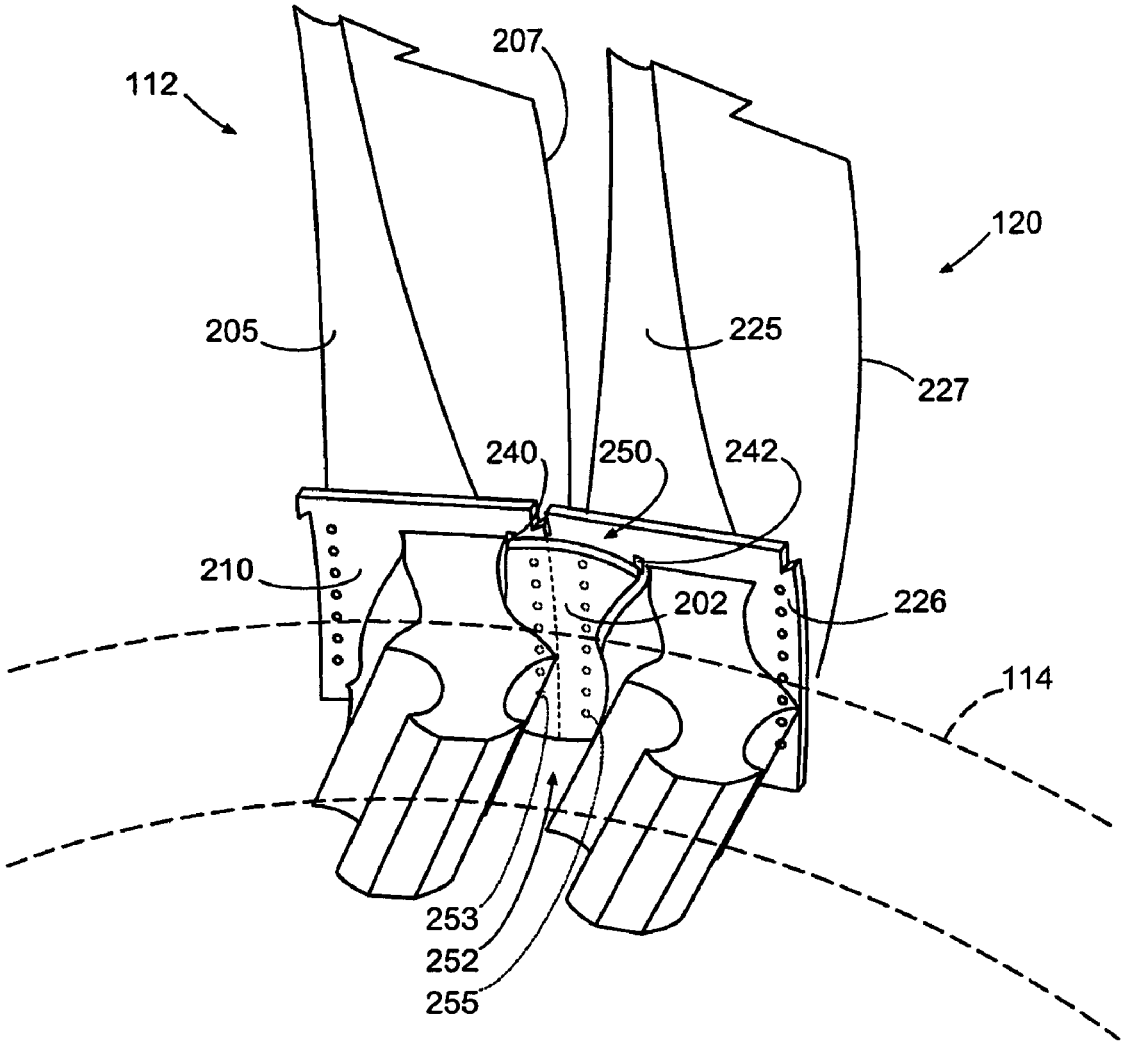
FIG. 3 is a perspective diagram depicting the baffle assembly of FIG. 2.

An exemplary embodiment of a baffle assembly is depicted in FIGS. 2 and 3, which depict the baffle assembly in association with blade 112 (FIG. 1) and an adjacent blade 120. As shown in FIG. 2, a baffle assembly 200 includes a blade underplatform baffle 202. The baffle 202 is configured for disposition between blades 112 and 120, on the inner diameter sides of the blade platforms. Specifically, blade 112 includes a blade airfoil 204 (which has a leading edge 205 and a trailing edge 207) that extends outwardly from an inner diameter platform 210. Platform 210 has a gas path (outer diameter) side 212 and a non-gas path (inner diameter) side 214. A blade mount 216 extends from the non-gas path side of the platform and is used to mount blade 112 to a turbine disk. Similarly, blade 120 includes a blade airfoil 224 (which has a leading edge 225 and a trailing edge 227) that extends outwardly from an inner diameter platform 226. Platform 226 has a gas path side 228 and a non-gas path side 230. A blade mount 232 extends from the non-gas path side 230 and is used to mount blade 120 to a turbine disk.

Baffle 202 is formed of temperature resistant material (e.g., cobalt sheet metal) and is sized and shaped to form a cooling air path of reduced cross-section 250 (FIG. 3) between the baffle and the non-gas path sides of the blade platforms 210 and 226. In this embodiment, the baffle is attached via rails located on adjacent sides of the blades 112, 120. Specifically, baffle 202 is attached to rails 240, 242. In some embodiments, the rails are located to position the baffle 202 at a distance of between approximately 0.030 inches (0.762 mm) and approximately 0.200 inches (5.08 mm), preferably between approximately 0.030 inches (0.762 mm) and approximately 0.060 inches (1.524 mm) from the underside of the platforms.

As shown in FIG. 3, baffle 202 effectively narrows plenum 252, which is located between the blade platforms 210, 226 and the rim of turbine disk 114 to which the blades are attached.

Cooling air path 250 formed by baffle 202 increases a velocity of cooling air flowing adjacent the inner diameter sides of the platforms 210, 226. Notably, the flow of cooing air enters near the leading edge of the blades and exits via film cooling holes (e.g., holes 253, 255) of the platforms.

This increase in velocity tends to increase the heat transfer coefficients, decrease platform temperatures, and reduce platform distress, which may otherwise be caused due to high temperatures. By way of example, in conventional blade platforms, without the presence of a baffle, the low backside heat transfer can be at a rate of approximately 50 BTU/ft$^2$/Hr/° F. and create an approximate temperature of 2050 degrees Fahrenheit on the inner diameter side of the blade platform. Such high platform temperatures can lead to platform distress. Notably, even though cooling air is typically used, that cooling air is generally routed through the relatively large plenum created between the blade platforms and the disk rim, which can be approximately 0.50 inches in conventional turbines.

However, the heat transfer in the representative embodiment of FIGS. 2 and 3 can be at a rate of between approximately 100 BTU/ft$^2$/Hr/° F. and approximately 350 BTU/ft$^2$/Hr/° F., such as between approximately 200 BTU/ft$^2$/Hr/° F. and approximately 300 BTU/ft$^2$/Hr/° F., for example. Such an increase in heat transfer can create an approximate temperature of 1800 degrees Fahrenheit on the underside of the blade platforms 210, 226.

Figure 4:
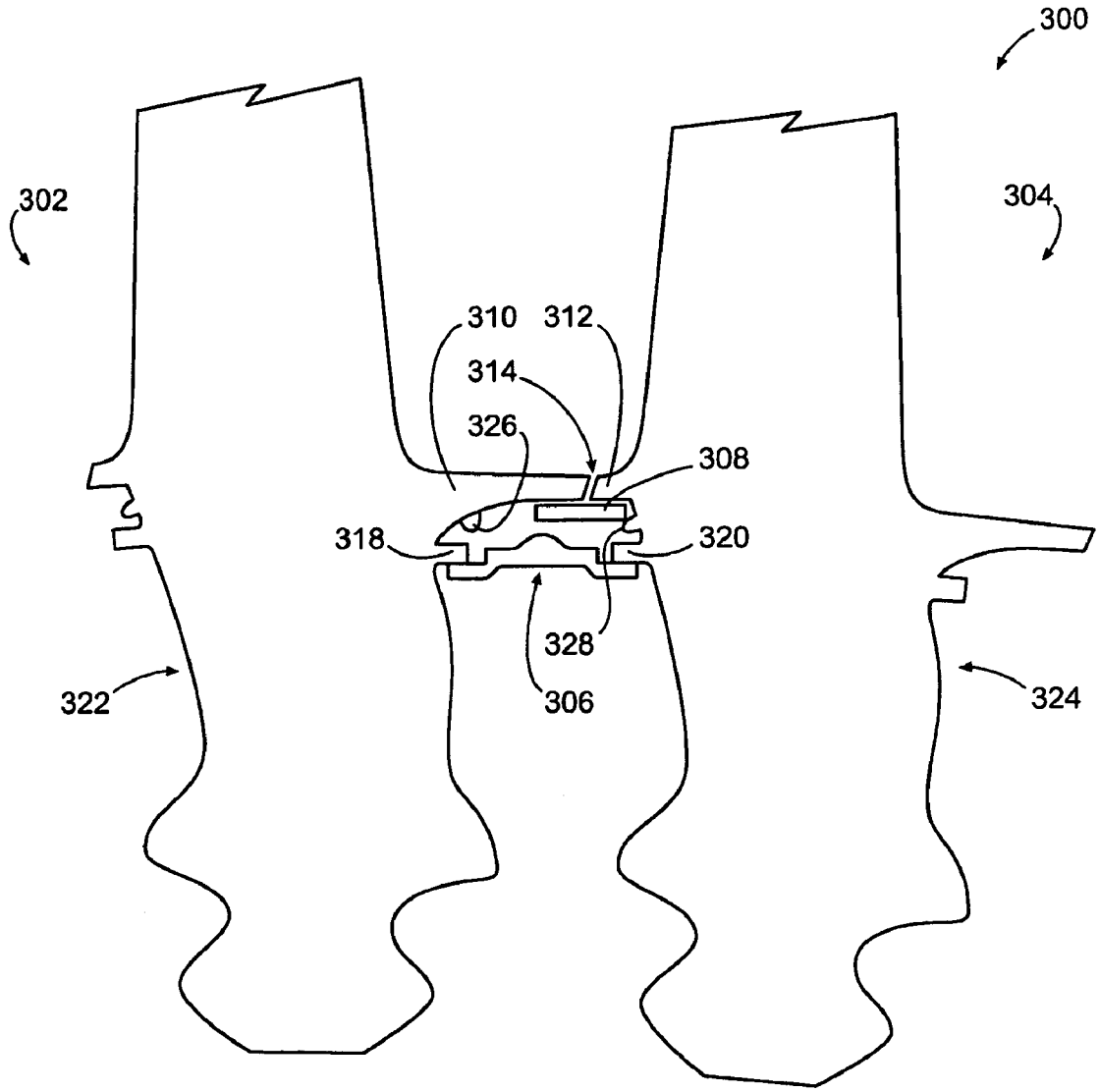
FIG. 4 is a cross-sectional diagram depicting another exemplary embodiment of a baffle assembly.

Another exemplary embodiment of a baffle assembly is depicted in FIG. 4. As shown in FIG. 4, assembly 300 includes adjacent blades 302, 304, with a baffle 306 being located between the blades. A feather seal 308 located between the baffle and the inner diameter sides of platforms 310, 312 seals a gap 314 located between the platforms.

In this embodiment, baffle 306 rides on rails 318, 320 that are located on the non-gas path sides 322, 324 of the blades. Pin fins also are provided on the non-gas path sides of the platforms of the blades. Specifically, platform 310 includes multiple pin fins (e.g., pin fin 326), and platform 312 includes multiple pin fins (e.g., pin fin 328).

The pin fins may enhance heat transfer coefficients and further reduce platform temperatures by increasing the surface area of the platforms in a vicinity of the cooling air flows directed by the baffle 306. Additionally, in some embodiments, the pin fins can function as standoffs for structurally supporting and/or positioning the baffle.

It should also be noted that, in some embodiments, a baffle can be sized and shaped to fit relatively loosely against an adjacent blade. As such, the baffle can provide a vibration damping function. Notably, the relatively loose fit enables the baffle to move relative to the blade thereby tending to compensate for vibrations.

Figure 5:
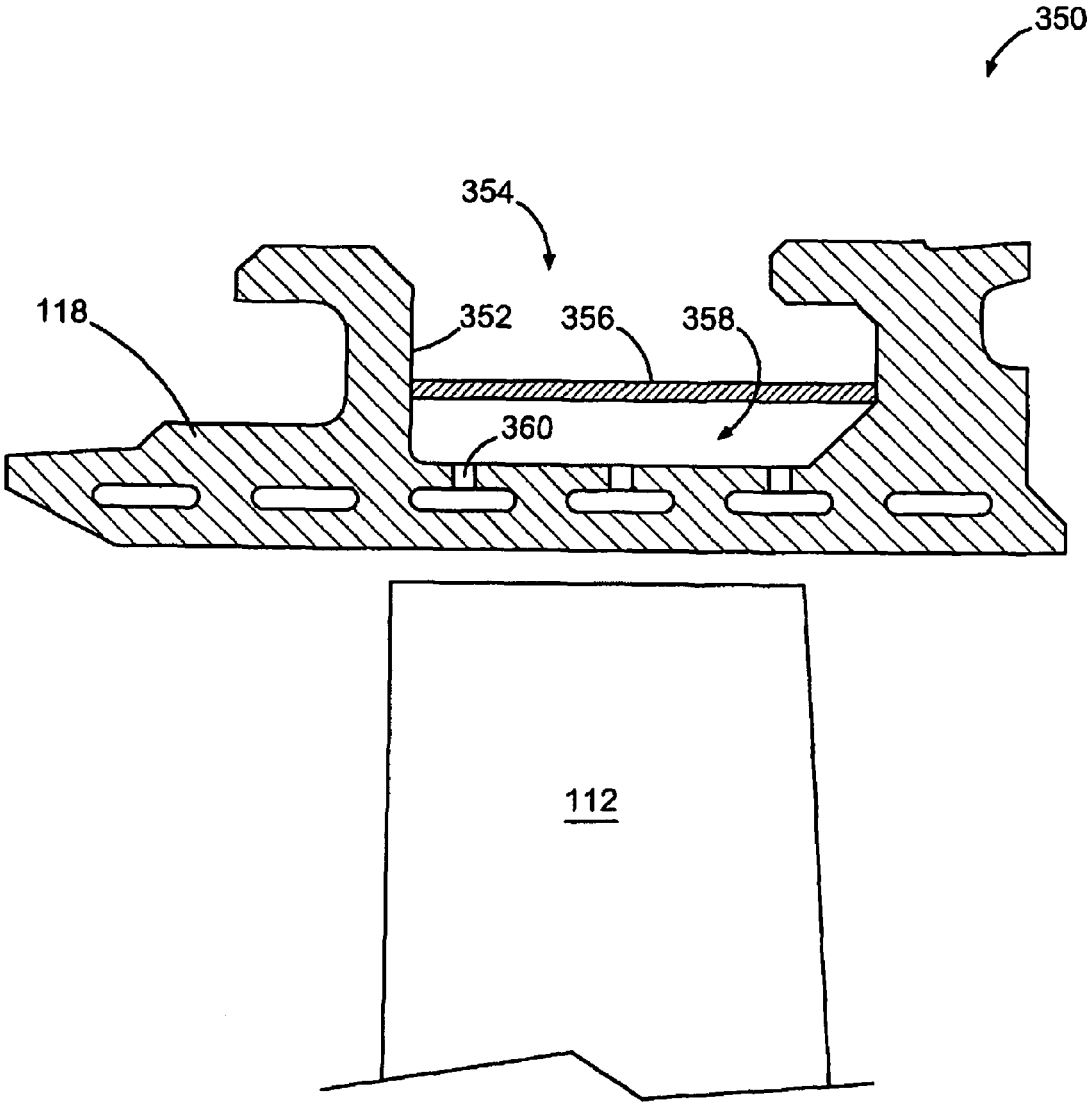
FIG. 5 is a cross-sectional diagram depicting another exemplary embodiment of a baffle assembly.

Another exemplary embodiment of a baffle assembly is depicted in FIG. 5. As shown in FIG. 5, assembly 350 includes blade outer air seal 118 (FIG. 1), which is one of multiple such seals that are positioned in end-to-end relationships with adjacent ones of the seals to form a circumferential seal about the tips of associated blades (e.g., blade 112). Outer diameter surfaces (e.g., surface 352) of blade outer air seal 118 define a portion of a cooling plenum 354. A baffle 356 is positioned within plenum 354 to form a cooling air path 358 of reduced cross-section compared to that of the cooling plenum.

In operation, cooling air provided for cooling the blade outer air seal 118 is directed between the baffle 356 and the outer diameter surfaces (e.g., surface 352). Thus, the baffle 356 causes the cooling air to be routed along cooling air path 358, which increases the velocity of the cooling air. In this embodiment, the cooling air enters cooling air path at an end of the blade outer air seal that is opposite that of cooling passage inlet holes (e.g., hole 360) so that the cooling air flows substantially along the length of the blade outer air seal before entering the cooling passage inlet holes.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A baffle assembly for a gas turbine engine comprising:

a first blade with a first airfoil and a first platform, the first platform between a gas path side and a non-gas path side, a first rail on the non-gas path side;

a second blade having a second airfoil and a second platform, the second platform between the gas path side and the a non-gas path side, a second rail on the non-gas path side; and a baffle which rides on the first rail and the second rail such that a cooling air path is formed between the baffle and the respective first platform and the second platform.

2. The assembly of claim 1, further comprising a feather seal positioned between the baffle and respective inner diameter sides of the first platform and the second platform, the feather seal operative to seal a gap between the first platform and the second platform.

3. The assembly of claim 1, wherein:

the first platform and the second platform have cooling holes formed therethrough, the cooling holes being oriented to direct cooling air from inner diameter sides to outer diameter sides of the platforms; and the baffle operative to route cooling air to the cooling holes.

4. The assembly of claim 1, further comprising pin fins extend from an inner diameter side of the first platform, with at least some of the pin fins being positioned to provide structural support for the baffle.

5. The assembly of claim 1, wherein the baffle is operative to shift position responsive to vibration of the first and second blades such that the baffle damps vibrations of the blades.

6. The assembly of claim 1, wherein the baffle is manufactured of cobalt sheet metal.

7. The assembly of claim 1, wherein the first rail and the second rail are located to position the baffle at a distance of between approximately 0.030 inches (0.762 mm) and approximately 0.200 inches (5.08 mm), from the underside of the platforms.

8. The assembly of claim 1, wherein the first rail and the second rail are located to position the baffle at a distance of between approximately 0.030 inches (0.762 mm) and approximately 0.060 inches (1.524 mm) from the underside of the platforms.

9. The assembly of claim 1, wherein the first rail and the second rail are adjacent to the respective the first platform and the second platform.

10. The assembly of claim 1, wherein the first rail and the second rail extend from the respective the first platform and the second platform.

11. A gas turbine engine assembly comprising:

a turbine disk;

a first blade mounted to the turbine disk, the first blade having a first platform between a gas path side and a non-gas path side, a first rail on said non-gas path side;

a second blade mounted to the turbine disk, the second blade having a second platform between the gas path side and the non-gas path side, a second rail on said non-gas path side; and a baffle which rides on the first rail and the second rail to form a cooling air path between the baffle and the first platform and the second platform.

12. The assembly of claim 11, wherein:

the first platform has cooling holes formed therethrough; and the baffle is operative to route cooling air to the cooling holes.

13. The assembly of claim 11, further comprising a feather seal positioned radially outboard of the baffle the feather seal operative to seal a gap between the first platform and the second platform.

14. The assembly of claim 11, wherein the first rail and the second rail are adjacent to an inner surface of the respective first platform and the second platform.

* * * * *